US012779518B2

(12) United States Patent
Kim

(10) Patent No.: US 12,779,518 B2
(45) Date of Patent: Nov. 3, 2026

(54) ULTRA-THICK STEEL MATERIAL HAVING EXCELLENT STRENGTH AND LOW TEMPERATURE IMPACT TOUGHNESS FOR FLANGE, AND MANUFACTURING METHOD THEREFOR

(71) Applicant: POSCO Co., Ltd, Pohang-si (KR)

(72) Inventor: Dae-Woo Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 244 days.

(21) Appl. No.: 18/701,739

(22) PCT Filed: Dec. 19, 2022

(86) PCT No.: PCT/KR2022/020730
§ 371 (c)(1),
(2) Date: Apr. 16, 2024

(87) PCT Pub. No.: WO2023/121186
PCT Pub. Date: Jun. 29, 2023

(65) Prior Publication Data

US 2025/0229310 A1 Jul. 17, 2025

(30) Foreign Application Priority Data

Dec. 21, 2021 (KR) ..... 10-2021-0183537

(51) Int. Cl.

| | |
|---|---|
| ***B21B 1/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/58*** | (2006.01) |

(52) U.S. Cl.
CPC ..... *B21B 1/024* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/58* (2013.01); *B21B 2001/022* (2013.01)

(58) Field of Classification Search
CPC ..... B21B 1/024; B21B 2001/022; C22C 38/002; C22C 38/02; C22C 38/06; C22C 38/42; C22C 38/44; C22C 38/46; C22C 38/48; C22C 38/58; C22C 38/04; C22C 38/50; C21D 2211/005; C21D 2211/009
See application file for complete search history.

(56) References Cited

U.S. PATENT DOCUMENTS

| | | | | |
|---|---|---|---|---|
| 2011/0108169 | A1 | 5/2011 | Beguinot et al. | |
| 2016/0010192 | A1 | 1/2016 | Kitsuya et al. | |
| 2017/0369958 | A1 | 12/2017 | Kitsuya et al. | |
| 2018/0155805 | A1 | 6/2018 | Kuronuma et al. | |
| 2019/0316219 | A1 | 10/2019 | Kang et al. | |
| 2020/0392608 | A1 * | 12/2020 | Bae | C21D 6/00 |
| 2022/0364193 | A1 | 11/2022 | So et al. | |

FOREIGN PATENT DOCUMENTS

| | | | |
|---|---|---|---|
| CN | 102517494 | A | 6/2012 |
| CN | 103695785 | A | 4/2014 |
| CN | 107217211 | A | 9/2017 |
| CN | 109338219 | B | 1/2020 |
| CN | 11128668 | A | 6/2020 |
| EP | 2 942 414 | A1 | 11/2015 |
| EP | 2679696 | B1 | 4/2019 |
| EP | 4 033 002 | A1 | 7/2022 |
| JP | 2016-117945 | A | 6/2016 |
| JP | 5928654 | B2 | 6/2016 |
| KR | 10-2012-0025009 | A | 3/2012 |
| KR | 10-2012-0074638 | A | 7/2012 |
| KR | 10-2012-0075246 | A | 7/2012 |
| KR | 10-2012-0126961 | A | 11/2012 |
| KR | 10-1253890 | B1 | 4/2013 |
| KR | 10-2017-0066612 | A | 6/2017 |
| KR | 10-1806340 | B1 | 12/2017 |
| KR | 10-2018-0073074 | A | 7/2018 |
| KR | 10-1994784 | B1 | 7/2019 |

(Continued)

OTHER PUBLICATIONS

Extended European Search Report dated Feb. 25, 2025 from the European Patent Office in Application No. 22911819.5.
Japanese Office Action dated Aug. 26, 2025 in Application No. 2024-536531.
International Search Report for PCT/KR2022/020730 dated Mar. 24, 2023.
Communication dated Aug. 25, 2026 from the China National Intellectual Property Administration in Chinese Patent Application No. 202280078987.1.
Liu Haikuan et al., "Research on SXQ345D-Z35 Ultra Heavy Plate for Large Hydrogenerator", Wide and Heavy Plate, vol. 23, No. 1, Feb. 2017, pp. 11-17 (6 pages total).

*Primary Examiner* — Adil A. Siddiqui
(74) *Attorney, Agent, or Firm* — Sughrue Mion, PLLC

(57) ABSTRACT

Provided are an ultrathick steel material having excellent strength and low-temperature impact toughness for flanges and a method for manufacturing same. The steel material of the present disclosure comprises, by wt %, C: 0.05-0.2%, Si: 0.05-0.5%, Mn: 1.0-2.0%, Al: 0.005-0.1%, P: 0.01% or less, S: 0.015% or less, Nb: 0.001-0.07%, V: 0.001-0.3%, Ti: 0.001-0.03%, Cr: 0.01-0.3%, Mo: 0.01-0.12%, Cu: 0.01-0.6%, Ni: 0.05-1.0%, Ca: 0.0005-0.004%, and the balance of Fe and inevitable impurities, has Ceq satisfying the range of 0.35-0.55 as calculated by the following equation, has an average ferrite grain size of 25 μm or less in the central portion thereof, and contains a microstructure including 5-30 area % of pearlite and the balance of ferrite.

11 Claims, No Drawings

(56) References Cited

FOREIGN PATENT DOCUMENTS

| | | | |
|---|---|---|---|
| KR | 10-2021-0032833 | A | 3/2021 |
| KR | 10-2021-0079847 | A | 6/2021 |
| WO | 2017/047088 | A1 | 3/2017 |
| WO | 2021/054672 | A1 | 3/2021 |
| WO | 2021/1 45442 | A1 | 7/2021 |

* cited by examiner

ULTRA-THICK STEEL MATERIAL HAVING EXCELLENT STRENGTH AND LOW TEMPERATURE IMPACT TOUGHNESS FOR FLANGE, AND MANUFACTURING METHOD THEREFOR

CROSS REFERENCE TO RELATED APPLICATIONS

This application is a National Stage of International Application No. PCT/KR2022/020730 filed Dec. 19, 2022, claiming priority based on Korean Patent Application No. 10-2021-0183537 filed Dec. 21, 2021, the entire disclosures of which are incorporated herein by reference.

TECHNICAL FIELD

The present disclosure relates to a steel material that can be used in a wind power generation tower and system, etc., and a manufacturing method therefor, and in particular, to an ultrathick steel material for a flange having excellent strength and low temperature impact toughness and a manufacturing method therefor.

BACKGROUND ART

Wind power generators are attracting attention as eco-friendly electricity generating means, and include parts such as a tower flange, a bearing, and a main shaft. Thereamong, the tower flange is a joint part required to connect towers, and 5 to 7 flanges are usually used in one tower. The tower flanges are installed at sea or in extreme cold regions, and therefore, require high durability. In particular, a size of a wind tower is also increasing in response to the demand for large-capacity energy production and high efficiency, so steel materials used in the wind tower are also continuously required to be to have high strength, high toughness, and high thickness. As a thickness of the material increases, the total amount of strain decreases, so a size of microstructure increases and the material tends to deteriorate due to defects within the material such as inclusions and segregation. Therefore, in order to improve internal and external soundness of the steel materials, there is a trend to reduce a concentration of impurities such as non-metallic inclusions or segregation, or to control cracks and voids on the surface and inside the material to an extreme.

In particular, in the case of ultrathick materials exceeding 200 mmt in thickness, the amount of strain in a central portion of the material is not large, so, when the unsolidified shrinkage voids generated during continuous casting or casting are not sufficiently compressed during a forging process, the shrinkage voids remain in the form of residual voids in a central portion of a flange.

These residual voids act as an initiation point of cracks when the structure is subjected to thickness axial stress, resulting in damage to the entire facility in the form of lamellar tearing. Therefore, before piercing (piercing forging) and ring forging (product forming) with a small amount of strain, it is necessary to sufficiently compress the central void so that no residual voids exist.

Patent Document 1 related thereto is a technology for applying high reduction in a thick plate rough rolling process. Specifically, Patent Document 1 uses a technology of determining a limit reduction rate for each thickness at which sheet bite occurs from a high reduction rate for each pass set to be close to a design tolerance (load and torque) of a rolling mill, a technology of distributing a reduction rate by adjusting an index of a thickness ratio for each pass to secure a target thickness of a roughing mill, and a technology of modifying a reduction rate to prevent sheet bite from occurring based on a limit reduction rate for each thickness, and provides a manufacturing method that can apply an average reduction rate of about 27.5% in final three passes of rough rolling based on 80 mmt. However, the above rolling method measures the average reduction rate of the entire product thickness, but, for ultrathick materials with a maximum thickness of 200 mmt or more, has technical difficulty applying high deformation to the center where residual voids exist.

One of the other methods of manufacturing ultrathick materials is a method for using a forging machine with the effective amount of strain per pass higher than that of the rolling mill. Patent Document 2 discloses that a slab containing, by mass %, C: 0.08 to 0.20%, Si: 0.40 or less, Mn: 0.5 to 5.0%, P: 0.010% or less, S: 0.0050% or less, Cr: 3.0% or less, Ni: 0.1 to 5.0%, Al: 0.010 to 0.080%, N: 0.0070% or less, and 0:0.0025% or less, satisfying the relationship of Equations 1 and 2, and containing the balance being Fe and inevitable impurities is subjected to hot forging a cumulative reduction amount of 25% or more, is heated from a temperature equal to or higher than an Ac3 point to a temperature equal to or lower than 1200° C. and hot rolled in a cumulative reduction amount of 45% or more, is rapidly cooled from a temperature equal to or higher than an Ar3 point to a temperature equal to or lower than 350° C. or equal to or lower than the Ar3 point, and is subjected to a tempering heat treatment process at a temperature of 450 to 700° C. to manufacture a thick, tough, high strength material that has a plate thickness equal to or more than 100 mmt, a yield strength equal to or more than 620 MPa, and absorbed energy equal to or more than 70J when evaluating low-temperature impact toughness at −40° C.

However, in the above manufacturing method, when the cumulative reduction amount is too high, surface defects may occur due to localized strain concentration. In particular, when surface layer or subsurface layer defects exist in a cast piece state before forging, the defects propagate during the forging process and thus the surface quality of product may further deteriorate after rolling. In addition, when the forging reduction amount per pass is insufficient, even if the cumulative reduction amount is high, it is difficult to sufficiently compress voids remaining in the central portion, and since the effective amount of strain in the central portion thereof is smaller compared to the strain of the surface layer, the rolling process is also not appropriate for controlling the voids and structure in the central portion of the ultrathick material.

Meanwhile, Patent Document 3 discloses that materials with a predetermined alloy composition may be heated to 1200 to 1350° C., hot forged with a cumulative reduction amount of 25% or more, heated to Ac3 point or higher and 1200° C. or higher, hot rolled at a cumulative reduction amount of 40% or more, reheated to Ac3 point or higher and 1050° C. or lower, rapidly cooled from a temperature of the Ac3 point or higher to a temperature on a lower side of 350° C. or lower or the Ar3 point or lower, and subjected to a tempering process at temperatures ranging from 450° C. to 700° C., thereby manufacturing a thick, tough, high strength steel plate of 100 mmt or more with a yield strength of 620 MPa or more.

However, the ultra-high strength steel sheet described above has a high carbon equivalent (Ceq) and hardenability index (DI), and therefore, may be vulnerable to surface cracks during casting, and the steel materials for flanges manufactured through normalizing heat treatment may not be easily applied with the relevant process conditions. In addition, when the carbon equivalent (Ceq) and hardenability index (DI) are high, cracks easily occur in the surface layer of the cast piece due to the generation of hard tissue of the surface layer during a secondary cooling process of steelmaking, and the cracks propagate during the forging process, resulting in the deterioration in the surface quality of the final product.

Therefore, a method for performing forging to improve internal soundness of a final product by compressing a central void was proposed, but there is no practical method for ensuring both appropriate material and excellent surface quality of a steel material for a flange.

RELATED ART DOCUMENT

Patent Document (Patent Document 1) Korean Patent Laid-Open Publication No. 10-2012-0075246 (published on Jul. 6, 2012)

(Patent Document 2) Korean Patent Laid-Open Publication No. 10-2017-0095307 (published on Aug. 22, 2017)

(Patent Document 3) Korean Patent Laid-Open Publication No. 10-2017-0095307 (published on Aug. 22, 2017)

DISCLOSURE

Technical Problem

The present disclosure provides an ultrathick steel material for a flange having excellent strength and low-temperature impact toughness, and a manufacturing method therefor.

The subject of the present disclosure is not limited to the above. A person skilled in the art will have no difficulty understanding the further subject matter of the present disclosure from the general content of this specification.

Technical Solution

In an aspect in the present disclosure, there is provided an ultrathick steel material for a flange includes: by wt %, C: 0.05 to 0.2%, Si: 0.05 to 0.5%, Mn: 1.0 to 2.0%, Al: 0.005 to 0.1%, P: 0.01% or less, S: 0.015% or less, Nb: 0.001 to 0.07%, V: 0.001 to 0.3%, Ti: 0.001 to 0.03%, Cr: 0.01 to 0.3%, Mo: 0.01 to 0.12%, Cu: 0.01 to 0.6%, Ni: 0.05 to 1.0%, Ca: 0.0005 to 0.004%, and the balance of Fe and inevitable impurities, has Ceq satisfying a range of 0.35 to 0.55 as calculated by the following equation 1, the ultrathick steel material has a microstructure comprising of 5 to 30 area % of pearlite and the balance of ferrite, and the ferrite has an average grain size of 25 μm or less in a central portion of the steel material, in which a porosity of the central portion of the steel material, which is an area of ⅜t to ⅝t in a thickness direction from a surface of the steel material, is 0.05 $mm^3/g$ or less, and the number of strain-induced NbC precipitates of 5 to 50 nm observed in a cross-section of the steel material is 10 or more, and the number of coarse precipitates of 100 nm or more is 5 or less, per 1 $\mu m^2$.

$$Ceq = [C] + [Mn]/6 + ([Cr] + [Mo] + [V])/5 + ([Ni] + [Cu])/15 \quad \text{[Equation 1]}$$

In the above equation 1, [C], [Mn], [Cr], [Mo], [V], [Ni], and [Cu] mean a content (wt %) of C, Mn, Cr, Mo, V, Ni, and Cu contained in the steel material, respectively, and when these components are not intentionally added, 0 is substituted.

The steel material may have a thickness of 200 to 500 mm.

The steel material may have a tensile strength of 500 to 700 MPa, a yield strength of 350 MPa or more, and a Charpy impact test absorption energy value of 50 J or more at −50° C.

A maximum surface crack depth of the steel material may be 0.1 mm or less (including 0).

In another aspect in the present disclosure, there is provided a manufacturing method for an ultrathick steel material for a flange, includes:

preparing a slab comprising, by wt %, C: 0.05 to 0.2%, Si: 0.05 to 0.5%, Mn: 1.0 to 2.0%, Al: 0.005 to 0.1%, P: 0.01% or less, S: 0.015% or less, Nb: 0.001 to 0.07%, V: 0.001 to 0.3%, Ti: 0.001 to 0.03%, Cr: 0.01 to 0.3%, Mo: 0.01 to 0.12%, Cu: 0.01 to 0.6%, Ni: 0.05 to 1.0%, Ca: 0.0005 to 0.004%, and the balance of Fe and inevitable impurities, and Ceq satisfying a range of 0.35 to 0.55 as calculated by the following equation 1 and then heating the slab in a temperature within a range of 1100 to 1300° C.;

performing primary upsetting on the heated slab at a forging ratio of 1.3 to 2.4 and then bloom forging on the heated slab at a forging ratio of 1.5 to 2.0;

reheating the bloom-forged material to a temperature within a range of 1100 to 1300° C.;

performing secondary upsetting on the reheated bloom-forged material at a forging ratio of 1.3 to 2.3 and then round forging on the reheated bloom-forged material at a forging ratio of 1.65 to 2.25;

performing tertiary upsetting on the round-forged material at a forging ratio of 2.0 to 2.8 so that a cumulative reduction amount is 10% or more at a temperature of recrystallization temperature or lower defined by the following equation 2;

performing hole processing on the tertiary upset material, reheating the tertiary upset material to a temperature within a range of 1100 to 1300° C., and then performing ring forging on the reheated tertiary upset material at a forging ratio of 1.0 to 1.6; and performing normalizing heat treatment by heating the ring-forged material to a temperature within a range of 820 to 930° C. that is a temperature measured based on the central portion thereof, maintaining the heated ring-forged material for 5 to 600 minutes, and then air cooling the heated ring-forged material to room temperature.

$$Ceq = [C] + [Mn]/6 + ([Cr] + [Mo] + [V])/5 + ([Ni] + [Cu])/15 \quad \text{[Equation 1]}$$

In the above equation 1, [C], [Mn], [Cr], [Mo], [V], [Ni], and [Cu] mean a content (wt %) of C, Mn, Cr, Mo, V, Ni, and Cu contained in the steel material, respectively. and Cu content (% by weight), and when these components are not intentionally added, 0 is substituted.

$$T_{nr}\,(^{\circ}C) = 887 + 464 \times C + 890 \times Ti + 363 \times Al - 357 \times Si + (6445 \times Nb - 644 \times Nb^{1/2}) + (732 \times V - 230 \times V^{1/2}) \quad \text{[Equation 2]}$$

The slab may be manufactured using one of a continuous casting process, a semi-continuous casting process, and an ingot casting process.

A size of a forged surface punched during the primary upsetting may be 1000 to 1200 mm×1800 to 2000 mm when an initial size is 700 mm×1800 mm.

For the bloom forging, the size of the forged surface upon the completion of forging may be 1450 to 1850 mm×2100 to 2500 mm when an initial size is 1000 to 1200 mm×1800 to 2000 mm.

When the secondary upsetting and round forging end, a size of the product may be 1450 to 1850Ø×1300 to 1700 mm.

When the tertiary upsetting ends, a size of the product may be 2300 to 2800Ø×400 to 800 mm.

A maximum thickness of the flange made of the steel material may be 200 to 500 mm, an inner diameter may be 4000 to 7000 mm, and an outer diameter may be 5000 to 8000 mm.

Advantageous Effects

According to the present disclosure having the configuration as described above, by compressing voids in a central portion of a steel material by optimizing a forging process to improve internal soundness, it is possible to effectively provide an ultrathick steel material that can be used for a flange having excellent strength and low-temperature impact toughness.

BEST MODE

The present disclosure relates to an ultrathick steel material for a flange having excellent strength and low-temperature impact toughness and a manufacturing method for a product. Preferred implementation embodiments of the present disclosure will be described below. Implementation embodiments of the present disclosure may be modified into several forms, and it is not to be interpreted that the scope of the present disclosure is limited to exemplary embodiments described in detail below. The present implementation embodiments are provided to explain the present disclosure in more detail to those skilled in the art to which the present disclosure pertains.

Hereinafter, the ultrathick steel material for flanges having excellent strength and low-temperature impact toughness of the present disclosure will be described in more detail.

According to the present disclosure, an ultrathick steel material for a flange having excellent strength and low temperature impact toughness includes, by wt %, C: 0.05 to 0.2%, Si: 0.05 to 0.5%, Mn: 1.0 to 2.0%, Al: 0.005 to 0.1%, P: 0.01% or less, S: 0.015% or less, Nb: 0.001 to 0.07%, V: 0.001 to 0.3%, Ti: 0.001 to 0.03%, Cr: 0.01 to 0.3%, Mo: 0.01 to 0.12%, Cu: 0.01 to 0.6%, Ni: 0.05 to 1.0%, Ca: 0.0005 to 0.004%, and the balance of Fe and inevitable impurities, has Ceq satisfying a range of 0.35 to 0.55 as calculated by the following equation 1, the ultrathick steel material has a microstructure comprising of 5 to 30 area % of pearlite and the balance of ferrite, and the ferrite has an average grain size of 25 μm or less in a central portion of the steel material, a porosity of the central portion of the steel material, which is an area of ⅜t to ⅝t in a thickness direction from a surface of the steel material, is 0.05 $mm^3/g$ or less, and the number of strain-induced NbC precipitates of 5 to 50 nm observed in a cross-section of the steel material is 10 or more, and the number of coarse precipitates of 100 nm or more is 5 or less, per 1 $\mu m^2$.

Hereinafter, alloy compositions of the present disclosure will be described in detail. Hereinafter, unless otherwise stated, % and ppm described in relation to alloy compositions are based on weight.

Carbon (C): 0.05 to 0.20%

Carbon (C) is the most important element in securing basic strength, so it needs to be contained in steel within an appropriate range. To achieve this added effect, 0.05% or more of carbon (C) may be added. Preferably, 0.10% or more of carbon (C) may be added. On the other hand, when the carbon (C) content exceeds a certain level, a pearlite fraction may excessively increase during normalizing heat treatment and strength and hardness of a base material may be excessively exceeded, so surface cracks may occur during the forging processing and properties of low-temperature impact toughness and Lamellar tearing of a final product may be reduced. Therefore, the present disclosure may limit the carbon (C) content to 0.20%. A more preferable upper limit of the carbon (C) content may be 0.18%.

Silicon (Si): 0.05 to 0.50%

Silicon (Si) is a substitutional element, and is an essential element in manufacturing of clean steel since it improves the strength of the steel material through solid solution strengthening and has a strong deoxidation effect. Therefore, the silicon (Si) may be added in an amount of 0.05% or more, and more preferably, 0.20% or more. On the other hand, when a large amount of silicon (Si) is added, the silicon (Si) may generate a martensite-austenite (MA) phase and excessively increases ferrite matrix strength, which may cause deterioration in surface quality of the ultrathick material products, so the upper limit of the silicon (Si) content may be limited to 0.50%. A more preferable upper limit of the silicon (Si) content may be 0.40%.

Manganese (Mn): 1.0 to 2.0%

Manganese (Mn) is a useful element that improves strength through solid solution strengthening and improves hardenability to generate low-temperature transformation phase. Therefore, in order to secure a tensile strength of 550 MPa or more, it is preferable to add 1.0% or more of manganese (Mn). A more preferable manganese (Mn) content may be 1.1% or more. On the other hand, the manganese (Mn) may form MnS which is an elongated non-metallic inclusion with sulfur(S) to reduce toughness and act as an impact initiation point, which may be a factor that drastically reduces the low-temperature impact toughness of a product. Therefore, it is preferable to manage the manganese (Mn) content to 2.0% or less, and a more preferable manganese (Mn) content may be 1.5% or less.

Aluminum (Al): 0.005 to 0.1%

Aluminum (Al) is one of the powerful deoxidizers in the steelmaking process along with the silicon (Si), and preferably added in an amount of 0.005% or more to achieve this effect. A more preferable lower limit of the aluminum (Al) content may be 0.01%. On the other hand, when the aluminum (Al) content is excessive, the fraction of $Al_2O_3$ in the oxidizing inclusions generated as results of deoxidation increases excessively to make the size of the inclusions coarsen and make it difficult to remove the inclusions during the refining, which may be a factor of reducing the low-temperature impact toughness. Therefore, it is preferable to manage the aluminum (Al) content to 0.1% or less. A more preferable aluminum (Al) content may be 0.07% or less.

Phosphorus (P): 0.010% or Less (Including 0%), Sulfur(S): 0.0015% or Less (Including 0%)

Phosphorus (P) and sulfur (s) are elements that cause embrittlement at grain boundaries or cause embrittlement by forming coarse inclusions. Therefore, in order to improve embrittlement crack propagation resistance, it is preferable to limit phosphorus (P) to 0.010% or less and sulfur(S) to 0.0015% or less.

Niobium (Nb) 0.001 to 0.07%

Niobium (Nb) is an element that improves strength of a base material by precipitating in the form of NbC or NbCN. In addition, the niobium (Nb) dissolved during the reheating at high temperature precipitates very finely in the form of Nbc during the rolling to suppress the recrystallization of austenite, thereby refining the structure. Therefore, it is preferable that the niobium (Nb) is added in an amount of 0.001% or more, and a more preferable niobium (Nb) content may be 0.05% or more. On the other hand, when the niobium (Nb) is excessively added, non-dissolved niobium (Nb) is generated in the form of TiNb (C, N), which is a factor that inhibits the low-temperature impact toughness, so it is preferable to limit the upper limit of niobium (Nb) content to 0.07%. A more preferable niobium (Nb) content may be 0.065% or less.

Vanadium (V): 0.001 to 0.3%

Since vanadium (V) t completely re-dissolved during the reheating, the strengthening effect is insignificant due to precipitation or solid solution strengthening during the subsequent rolling. However, in the case of forging the ultra-thick material, an air cooling rate is very slow, so very fine carbonitrides precipitates during the cooling or additional heat treatment process, which has the effect of improving the strength. To fully obtain this effect, it is necessary to add 0.001% or more of vanadium (V). A more preferable lower limit of the vanadium (Al) content may be 0.01%. On the other hand, when the vanadium content is excessive, the hardness of the surface layer of the slab may excessively increase due to high hardenability to not only cause a factor of surface cracks, etc., during the flange processing, but also cause a sharp increase in manufacturing cost, which is not commercially advantageous. Therefore, the vanadium (V) content may be limited to 0.3% or less. A more preferable vanadium (V) content may be 0.25% or less.

Titanium (Ti): 0.001 to 0.03%

Titanium (Ti) is a component that precipitates as TiN during the reheating and significantly improves low-temperature toughness by suppressing the growth of spherical austenite grains at high temperatures. To achieve this effect, it is preferable that 0.001% or more of titanium (Ti) is added. On the other hand, when the titanium (Ti) is excessively added, the low-temperature toughness may be reduced due to clogging of a continuous casting nozzle or crystallization in the central portion thereof. In addition, the titanium (Ti) combines with nitrogen (N) to form coarse TiN precipitates in the central portion of the thickness, which may reduce the elongation of the product, reduce the uniform elongation during the forging process and cause the surface cracks. Therefore, the titanium (Ti) content may be 0.03% or less. A preferable titanium (Ti) content may be 0.025% or less, and a more preferable titanium (Ti) content may be 0.018% or less.

Chromium (Cr): 0.01 to 0.30%

Chromium (Cr) is a component that increases yield strength and tensile strength by increasing hardenability and forming a low-temperature transformation structure. In addition, the chromium (Cr) is a component that is effective in preventing a decrease in strength by slowing down a spheroidization rate of cementite. For this effect, 0.01% or more of chromium (Cr) may be added. On the other hand, when the chromium (Cr) content is excessive, the size and fraction of Cr-Rich coarse carbides such as $M_{23}C_6$ increase, which may reduce the impact toughness of the product, and reduce the solid solubility of niobium (Nb) in the product and the fraction of fine precipitates such as NbC, so there may be the problem of reducing the strength of the product. Therefore, the present disclosure may limit the upper limit of the chromium (Cr) content to 0.30%. The preferable upper limit of the chromium (Cr) content may be 0.25%.

Molybdenum (Mo): 0.01 to 0.12%

Molybdenum (Mo) is an element that increases grain boundary strength, increases solid solution strengthening in ferrite, and is an element that effectively contributes to increasing the strength and ductility of products. In addition, the molybdenum (Mo) has the effect of preventing a decrease in toughness due to grain boundary segregation of impurity elements such as phosphorus (P). For this effect, 0.10% or more of molybdenum (Mo) may be added. However, the molybdenum (Mo) is an expensive element and when the molybdenum (Mo) is excessively added, the manufacturing costs may increase significantly, so the upper limit of the molybdenum (Mo) content may be limited to 0.12%.

Copper (Cu): 0.01 to 0.60%

Copper (Cu) is an advantageous element in the present disclosure since it may not only greatly improve the strength of the matrix phase through the solid solution strengthening in ferrite, but also suppress corrosion in a wet hydrogen sulfide atmosphere. For this effect, 0.01% or more of copper (Cr) may be added. A more preferable copper (Cu) content may be 0.03% or more. However, when the copper (Cu) content is excessive, the possibility of causing star cracks on the surface of the steel sheet increases, and as the copper (Cu) is an expensive element, there may be a problem of significantly increasing manufacturing costs. Therefore, the present disclosure may limit the upper limit of copper (Cu) content to 0.60%. The preferable upper limit of the copper (Cu) content may be 0.35%.

Nickel (Ni): 0.05 to 1.00%

Nickel (Ni) is an element that effectively contributes to improving impact toughness by increasing stacking defects at low temperature to facilitating cross slip of dislocations, and improving strength by improving hardenability. For this effect, 0.05% or more of nickel (Ni) may be added. A preferred nickel (Ni) content may be 0.10% or more. On the other hand, when the nickel (Ni) is excessively added, the manufacturing costs may increase due to the high cost, so the upper limit of the nickel (Ni) content may be limited to 1.00%. The preferable upper limit of the nickle (Ni) content may be 0.80%.

Calcium (Ca) 0.0005 to 0.0040%

When calcium (Ca) is added after deoxidation with aluminum (Al), the calcium (Ca) combines with sulfur(S) forming MnS inclusions to suppress the generation of MnS, and at the same time form spherical Cas, thereby suppressing cracks caused by hydrogen-induced cracking from occurring. In order to sufficiently form the sulfur(S) contained as an impurity into CaS, it is preferable to add 0.0005% or more of calcium (Ca). However, when the added amount is excessive, calcium (Ca) remaining after forming CaS combines with oxygen (O) to generate coarse oxidative inclusions, which may be a factor in reducing properties of Lamellar tearing due to elongation and destruction during the rolling. Therefore, the upper limit of calcium (Ca) content may be limited to 0.0040%.

Equation 1

Ceq according to the following Equation 1 is required to satisfy the range of 0.35 to 0.55. When the Ceq according to the above Equation 1 is less than 0.35, the pearlite fraction is reduced, so the tensile strength value of 500 to 700 MPa required in the present disclosure may not be secured, and when the Ceq exceeds 0.55, the pearlite fraction exceeds 30%, so it is not easy to secure the low-temperature impact energy values at −50° C. Therefore, in the present disclosure, the Ceq is preferable in the range of 0.35 to 0.55.

$$Ceq = [C] + [Mn]/6 + ([Cr] + [Mo] + [V])/5 + ([Ni] + [Cu])/15 \quad \text{[Equation 1]}$$

In the above equation 1, [C], [Mn], [Cr], [Mo], [V], [Ni], and [Cu] mean a content (wt %) of C, Mn, Cr, Mo, V, Ni, and Cu contained in the steel material, respectively, and when these components are not intentionally added, 0 is substituted.

The ultrathick steel material for a flange having excellent strength and low-temperature impact toughness of the present disclosure and products thereof may contain the balance being Fe and other inevitable impurities in addition to the above-described components. However, since the unintended impurities from raw materials or the surrounding environment may inevitably be mixed in a normal manufacturing process, the unintended impurities may not be completely excluded. Since these impurities are known to those skilled in the art, all thereof are not specifically mentioned in this specification. In addition, the additional addition of the effective components in addition to the above-described components is not completely excluded.

Meanwhile, the ultrathick steel material of the present disclosure preferably has a microstructure comprising of 5 to 30 area % of pearlite and the balance of ferrite, and the ferrite has an average grain size of 25 μm or less in a central portion of the steel material.

When the average ferrite grain size present in the central portion of the steel material exceeds 25 μm, the length of the crack path during the impact fracture is shortened, and ductile brittle transition temperature (DBTT) increases, SO the low-temperature impact toughness deteriorates. Therefore, it is appropriate that the average ferrite grain size is 25 μm or less.

In addition, when the pearlite fraction in the steel material microstructure is less than 5 area %, it is not appropriate to secure a tensile strength value of 500 MPa or more, and when the pearlite fraction exceeds 30 area %, the low-temperature impact toughness value at −50° C. may deteriorate due to the increase in hard structure.

In addition, a porosity of the central portion of the steel material, which is an area of ⅜t to ⅝t in a thickness direction from a surface of the steel material, may be 0.05 $mm^3/g$ or less.

In addition, the steel material of the present disclosure may have 10 or more strain-induced NbC precipitates of 5 to 50 nm and 5 or less coarse precipitates of 100 nm or more per 1 $\mu m^2$ in its matrix structure. When the number of strain-induced NbC precipitates of 5 to 50 nm is less than 10, the precipitation strengthening effect is weakened, and when the number of coarse precipitates of 100 nm or more exceeds 5, the pinning effect and precipitation strengthening effect are lost, so it is not easy to secure the tensile strength of 500 to 700 MPa required in the present disclosure.

In addition, the ultrathick steel material of the present disclosure may have a thickness of 200 to 500 mm.

In addition, the steel material of the present disclosure may have a tensile strength of 500 to 700 MPa, a yield strength of 350 MPa or more, and a Charpy impact test absorption energy value of 50 J or more at −60° C.

In addition, the maximum surface crack depth of the steel material may be 0.1 mm or less (including 0).

Next, a manufacturing method for an ultrathick steel material for a flange having excellent strength and low-temperature impact toughness according to another aspect of the present disclosure will be described in more detail.

The manufacturing method of an ultrathick steel material of the present disclosure includes: preparing a slab having the composition components as described above and then heating the slab in a temperature within a range of 1100 to 1300° C.; performing primary upsetting on the heated slab at a forging ratio of 1.3 to 2.4 and then bloom forging on the heated slab at a forging ratio of 1.5 to 2.0; reheating the bloom-forged material to a temperature within a range of 1100 to 1300° C.; performing secondary upsetting on the reheated bloom-forged material at a forging ratio of 1.3 to 2.3 and then round forging on the reheated bloom-forged material at a forging ratio of 1.65 to 2.25; performing tertiary upsetting on the round-forged material at a forging ratio of 2.0 to 2.8 so that a cumulative reduction amount is 10% or more at a temperature of recrystallization temperature or lower defined by the following equation 2; performing hole processing on the tertiary upset material, reheating the tertiary upset material to a temperature within a range of 1100 to 1300° C., and then performing ring forging on the reheated tertiary upset material at a forging ratio of 1.0 to 1.6; and performing normalizing heat treatment by heating the ring-forged material to a temperature within a range of 820 to 930° C. that is a temperature measured based on the central portion thereof, maintaining the heated ring-forged material for 5 to 600 minutes, and then air cooling the heated ring-forged material to room temperature.

Heating Slab

First, in the present disclosure, a slab having the composition as described above is prepared and then heated to a temperature within a range of 1100 to 1300° C.

It is necessary to heat the slab above a certain temperature range to re-dissolve the composite carbonitride of titanium (Ti) or niobium (Nb), coarse crystallized TiNb (C, N), etc., formed during the casting. In addition, before the primary upsetting forging, the slab is heated and maintained above the recrystallization temperature to homogenize the structure, and is heated above a certain temperature range so that the forging end temperature is sufficiently high to minimize surface cracks that may occur during the forging process. Therefore, it is preferable to heat the slab of the present disclosure in a temperature within a range of 1100° C. or higher.

On the other hand, when the heating temperature of the slab is excessively high, the high-temperature oxidation scale may be excessively generated, and the increase in manufacturing costs may be excessive due to the high-temperature heating and maintenance. Therefore, it is preferable that the primary heating of the slab of the present disclosure is performed in the range of 1300° C. or lower.

Meanwhile, in the present disclosure, the thickness of the slab may be 500 mm or more, and a preferred thickness of the slab may be 700 mm or more.

Primary Upsetting and Bloom Forging

Next, in the present disclosure, the heated slab to a forging ratio of 1.3 to 2.4 is subjected to the primary upsetting and then subjected to the bloom forging to a forging ratio of 1.5 to 2.0.

The upsetting is a method for rigidly deforming a material vertically along a longitudinal axis, and the forging ratio during the primary upsetting may be preferably 1.3 to 2.4, and more preferably 1.5 to 2.0. Here, the forging ratio refers to the ratio of the cross-sectional area changed by the forging. A size of a forged surface punched during the primary upsetting may be 1000 to 1200 mm×1800 to 2000 mm when an initial size is 700 mm×1800 mm.

When the forging ratio is less than 1.3 during the primary upsetting, it is difficult to sufficiently compress the porosity remaining in the central portion of the slab. Therefore, since it is difficult to control the porosity required for the final product of the present disclosure to an appropriate level of 0.05 $mm^3/g$ or less, it is not easy to secure the low-temperature impact toughness in the central portion thereof. On the other hand, when the forging ratio exceeds 2.4 during the primary upsetting, buckling occurs during the forging process, making it difficult to control the surface quality and appropriate shape required for flange products. Therefore, during the primary upsetting, the forging ratio is preferably 1.3 to 2.4.

In the present disclosure, the bloom forging is performed on the primary upsetting material to a forging ratio of 1.5 to 2.0.

The bloom forging is a method for processing a material subjected to primary upsetting into a bloom shape by further compressing the material subjected to the primary upsetting, and is a method for expanding an area by processing both upper and lower surfaces in a certain direction of width or length. For the bloom forging, the size of the forged surface upon the completion of forging may be 1450 to 1850 mm×2100 to 2500 mm when an initial size is 1000 to 1200 mm×1800 to 2000 mm. In the case of bloom forging, the forging ratio is preferably 1.5 to 2.0. This is because, when the forging ratio is less than 1.5, it is difficult to secure the appropriate void quality required in the present disclosure as in the upsetting forging, and when the forging ratio exceeds 2.0, the surface cracks may occur.

The forging progress direction is possible in both the longitudinal and width directions, but in the longitudinal direction, the casting structure is configured to be denser, so the elongation of the surface layer may increase and processability may be excellent. Therefore, the longitudinal bloom forging may be more appropriate than width direction in view of the surface crack.

Reheating

In the present disclosure, the bloom-forged material is reheated to a temperature within a range of 1100 to 1300° C.

When the bloom forging ends, the bloom surface temperature is 950° C. or lower, and when the processing continues, the surface cracks or material fracture may occur. Therefore, after the bloom forging, the material may be heated again to a temperature within a range of 1100 to 1300° C. As described above, it is preferable to heat the material at 1100° C. or higher for reasons such as re-dissolving the crystallized material, homogenizing the structure, and preventing surface cracks, and it is better to control the material to 1300° C. or lower due to problems such as excessive scale and coarsening of grains.

Secondary Upsetting-Round Forging

Next, the reheated bloom-forged material is subjected to the secondary upsetting at a forging ratio of 1.3 to 2.3 and then round forged at a forging ratio of 1.65 to 2.25.

That is, in the present disclosure, the heated bloom material is subjected to the secondary upsetting at a forging ratio of 1.3 to 2.3, and then round-forged at a forging ratio of 1.65 to 2.25 in order to process the bloom into a circular shape of the flange border. When the secondary upsetting and round forging end, the size of the product may be 1450 to 1850Ø×1300 to 1700 mm.

During the secondary upsetting and round forging, when the forging ratio is below the level required in the present disclosure, it is difficult to control the central porosity in the final product to 0.05 $mm^3/g$ or less, making it difficult to secure the low-temperature impact toughness in the central portion of the steel material. On the other hand, when the forging ratio level of the present disclosure is exceeded, it cannot be processed into the desired flange product shape due to the problems such as buckling, the occurrence of surface cracks, and the poor shape.

Tertiary Upsetting (Generation of Strain-Induced Precipitates)

Subsequently, in the present disclosure, the tertiary upsetting is performed on the round-forged material at a forging ratio of 2.0 to 2.8 so that the cumulative reduction amount is 10% or more at a temperature of recrystallization temperature or lower defined by the following equation 2 below.

The material processed into the cylindrical shape may be processed to an appropriate thickness of the flange through the tertiary upsetting before the hole processing (piercing). When the tertiary upsetting ends, the size of the product may be 2300 to 2800Ø×400 to 800 mm.

The forging ratio of the tertiary upsetting may be 2.0 to 2.8, and when the forging ratio is insufficient or exceeded, problems such as the above-mentioned residual void control and surface crack/shape control inability may occur.

What is important in this tertiary upsetting process is the cumulative reduction amount at a temperature of the recrystallization temperature (Rst) or lower of the steel material, and the forging and rolling is performed so that the cumulative reduction amount is 10% or more. In this case, the recrystallization temperature may be calculated by the following Equation 2.

$$T_{nr}\,(°C) = 887 + 464\times C + 890\times Ti + 363\times Al - 357\times Si + (6445\times Nb - 644\times Nb^{1/2}) + (732\times V - 230\times V^{1/2}) \quad \text{[Equation 2]}$$

When the cumulative reduction amount is less than 10% at a temperature of the recrystallization temperature or lower, it is not easy to generate the strain-induced ultrafine NbC or NbCN precipitates of 5 to 50 nm, and the number of the precipitates is less than 10 or the number of coarse precipitates with a size of 100 nm or more may exceed 5, per 1 $\mu m^2$. When the amount of fine precipitates is reduced or the size is increased, the precipitation strengthening effect is insignificant, and the pinning effect is reduced when the normalizing temperature is increased, so it is not easy to secure the average ferrite grain size in the central portion of the product below 25 μm. Therefore, it is preferable to control the cumulative reduction amount to 10% or more, more preferably 15% or more, and most preferably 20% or more, at a temperature of the recrystallization temperature or lower.

Hole Processing and Ring Forging

Next, in the present disclosure, after the hole processing is performed on the material subjected to the tertiary upsetting, the material subjected to the tertiary upsetting is reheated to a temperature within a range of 1100 to 1300° C., and then subjected to performing the ring forging at a forging ratio of 1.0 to 1.6.

After the tertiary upsetting ends, the hole may be machined in the central portion of the material using a 500 to 1000Ø punch.

The hole-processed material is reheated to the temperature within a range of 1100 to 1300° C. described above, and may then be processed into the final flange ring shape. The maximum thickness of the flange made of the steel material may be 200 to 500 mm, the inner diameter may be 4000 to 7000 mm, and the outer diameter may be 5000 to 8000 mm. The ring forging does not apply rigid plastic processing because it is more important to control the final shape and dimensions rather than compressing voids. Therefore, the forging ratio may be 1.0 to 1.6, and more preferably 1.2 to 1.4.

Meanwhile, the strain rate in all forging processes presented above in the present disclosure may be 1/s to 4/s. At the strain rate of less than 1/s, the temperature of the finish forging may drop and surface cracks may occur. On the other hand, when a high strain rate exceeding 4/s is applied in the non-recrystallized region, the surface cracks may occur due to the decrease in elongation due to excessive local work hardening.

Normalizing Heat Treatment

Finally, in the present disclosure, the ring-forged material is subject to the normalizing heat treatment. Specifically, the ring-forged material is heated to a temperature within a range of 820 to 930° C. that is a temperature measured based on the central portion thereof, maintained for 5 to 600 minutes, and then air cooling to room temperature.

The forged flange product may be subjected to the normalizing heat treatment. Specifically, the forged flange product is heated to a temperature within a range of 820 to 930° C. which is the temperature measured based on the central portion (t/2) of the product, maintained for 5 to 600 minutes, and then air cooling to room temperature.

During the normalizing heat treatment, when the heating temperature is less than 820° C. or the holding time is less than 5 minutes, the carbides generated during the cooling after the forging or the impurity elements segregated at the grain boundaries are not re-dissolved smoothly, so the low-temperature toughness of the steel material after the heat treatment may greatly deteriorate. On the other hand, during the normalizing heat treatment, when the heating temperature exceeds 930° C. or the holding time exceeds 600 minutes, the grain size of the ferrite matrix of the composite structure of the ferrite and pearlite exceeds 30 μm required in the present disclosure or the precipitated phases such as Nb (C, N) and V (C, N) become coarse, so the strength and low-temperature impact toughness may deteriorate.

MODE FOR INVENTION

Hereinafter, the present disclosure will be described in more detail with reference to Examples. However, it should be noted that the following Examples are only for illustrating the present disclosure in more detail and are not intended to limit the scope of the present disclosure.

Example

TABLE 1

| Division | C | Si | Mn | Al | P | Nb | V | Ti | Cr | Mo | Cu | Ni | Ca | Ceq |
|---|---|---|---|---|---|---|---|---|---|---|---|---|---|---|
| Inventive steel 1 | 0.17 | 0.37 | 1.44 | 0.01 | 83 | 0.021 | 0.023 | 0.005 | 0.17 | 0.09 | 0.19 | 0.35 | 20 | 0.50 |
| Inventive steel 2 | 0.16 | 0.29 | 1.35 | 0.02 | 62 | 0.02 | 0.031 | 0.013 | 0.09 | 0.07 | 0.12 | 0.29 | 18 | 0.45 |
| Inventive steel 3 | 0.15 | 0.3 | 1.39 | 0.03 | 88 | 0.017 | 0.021 | 0.008 | 0.15 | 0.08 | 0.25 | 0.18 | 17 | 0.46 |
| Inventive steel 4 | 0.17 | 0.33 | 1.36 | 0.02 | 75 | 0.015 | 0.08 | 0.011 | 0.16 | 0.11 | 0.16 | 0.22 | 18 | 0.49 |
| Inventive steel 5 | 0.18 | 0.3 | 1.2 | 0.03 | 65 | 0.009 | 0.031 | 0.013 | 0.23 | 0.06 | 0.38 | 0.29 | 22 | 0.49 |
| Comparative steel 1 | 0.04 | 0.35 | 1.33 | 0.05 | 73 | 0.016 | 0.043 | 0.009 | 0.08 | 0.08 | 0.43 | 0.24 | 21 | 0.35 |
| Comparative steel 2 | 0.16 | 0.36 | 0.65 | 0.04 | 77 | 0.011 | 0.023 | 0.016 | 0.11 | 0.07 | 0.25 | 0.18 | 18 | 0.34 |
| Comparative steel 3 | 0.21 | 0.38 | 3.64 | 0.01 | 69 | 0.027 | 0.025 | 0.009 | 0.15 | 0.05 | 0.16 | 0.76 | 20 | 0.92 |
| Comparative steel 4 | 0.15 | 0.36 | 1.37 | 0.03 | 81 | 0.002 | 0.021 | 0.009 | 0.16 | 0.1 | 0.15 | 0.29 | 21 | 0.46 |
| Comparative steel 5 | 0.24 | 0.28 | 1.83 | 0.04 | 81 | 0.009 | 0.03 | 0.01 | 0.29 | 0.12 | 0.41 | 0.3 | 19 | 0.68 |

*In Table 1, the unit of content of component elements is wt %, but the unit of P, S, and Ca is ppm. The residual components are Fe and inevitable impurities.

A 700 mm thick slab having the alloy components shown in Table 1 above was manufactured. The slab was subjected to slab preparation, forging process (reheating and primary upsetting, bloom forging, reheating, secondary upsetting-round forging, tertiary upsetting, reheating and ring forging), and normalizing heat treatment that are the process conditions in Table 2 below to manufacture a flange of a final 320 mmt. In this case, after the completion of the bloom forging, the reheating temperature for the secondary upsetting was 1230° C.±10° C., and forging ratio of the round forging after the secondary upsetting was applied equally at 2.0. In addition, process conditions satisfying the scope of the present disclosure were applied to all processes other than those listed in Table 2 below.

Thereafter, the physical values of each specimen manufactured above were measured and shown in Table 3 below. Here, the ferrite grain size and ferrite phase fraction were measured using an automatic image analyzer by collecting a specimen from the tissue specimen of the central portion after the normalizing heat treatment. Meanwhile, in this example, the product microstructure in both the Inventive Example and Comparative Example is a mixed structure of the ferrite and pearlite.

In addition, the yield/tensile strength was evaluated through a room temperature tensile test according to ASTM A370, and a 0.2% offset was applied for the yield strength. In addition, the impact toughness of each specimen used the average of the absorption energy values measured three times at the corresponding temperature through the Charpy V-notch test.

In addition, the number of strain-induced NbC precipitates of 5 to 50 nm observed in the cross-section of the steel material was measured using TEM. NbC precipitates were confirmed through NbC diffraction patterns and EDX mapping, and the number of NbC precipitates located in 1 $\mu m^2$ was counted.

The porosity of the central portion of the product was measured by measuring the density ($g/mm^3$) and taking the reciprocal ($mm^3/g$).

In addition, after visually observing the surface of each specimen, the grinding was performed at the point where the surface crack was formed, and the grinding length until cracks disappeared was measured as the surface crack length.

TABLE 2

| | | | | | | Tertiary upsetting | | |
|---|---|---|---|---|---|---|---|---|
| Division | Steel type | Heating temperature (° C.) | Primary upsetting forging ratio | Bloom forging forging ratio | Secondary upsetting forging ratio | Forging ratio | Cumulative reduction rate below Rst (%) | Normalizing temperature (° C.) |
| Inventive Example 1 | Inventive steel 1 | 1263 | 1.83 | 1.8 | 2.01 | 2.54 | 23 | 883 |
| Inventive Example 2 | Inventive steel 2 | 1234 | 1.75 | 1.69 | 1.98 | 2.46 | 19 | 889 |
| Inventive Example 3 | Inventive steel 3 | 1195 | 1.92 | 1.59 | 2.21 | 2.61 | 25 | 890 |
| Inventive Example 4 | Inventive steel 4 | 1241 | 1.86 | 1.83 | 2.07 | 2.33 | 24 | 813 |
| Inventive Example 5 | Inventive steel 5 | 1269 | 1.69 | 1.75 | 2.15 | 2.75 | 15 | 890 |
| Comparative Example 1 | Inventive steel 1 | 981 | 1.62 | 1.83 | 2.05 | 2.56 | 18 | 915 |
| Comparative Example 2 | Inventive steel 1 | 1196 | 1.1 | 1.85 | 2.14 | 2.65 | 17 | 877 |
| Comparative Example 3 | Inventive steel 2 | 1256 | 1.92 | 3.51 | 1.95 | 2.42 | 23 | 918 |
| Comparative Example 4 | Inventive steel 2 | 1268 | 1.62 | 1.85 | 3.1 | 2.68 | 29 | 925 |
| Comparative Example 5 | Inventive steel 3 | 1266 | 1.58 | 1.81 | 1.2 | 2.43 | 29 | 921 |
| Comparative Example 6 | Inventive steel 3 | 1273 | 1.59 | 1.84 | 2.15 | 1.3 | 28 | 910 |
| Comparative Example 7 | Inventive steel 4 | 1250 | 1.81 | 1.77 | 2.2 | 2.65 | 4 | 908 |
| Comparative Example 8 | Inventive steel 4 | 1264 | 1.76 | 1.76 | 1.95 | 0.19 | 24 | 957 |
| Comparative Example 9 | Comparative steel 1 | 1242 | 1.81 | 1.75 | 1.89 | 2.28 | 24 | 887 |
| Comparative Example 10 | Comparative steel 2 | 1200 | 1.7 | 1.81 | 1.87 | 2.64 | 23 | 901 |
| Comparative Example 11 | Comparative steel 3 | 1269 | 1.84 | 1.88 | 1.91 | 2.54 | 25 | 903 |
| Comparative Example 12 | Comparative steel 4 | 1168 | 1.88 | 1.76 | 1.95 | 2.35 | 29 | 905 |
| Comparative Example 13 | Comparative steel 5 | 1153 | 1.66 | 1.86 | 2.01 | 2.45 | 27 | 910 |

TABLE 3

| Division | Steel type | Ferrite grain size (μm) | Pearlite fraction (area %) | Number of strain-induced precipitates a+ | Number of strain-induced precipitates b+ | Porosity ($mm^3/g$) | Mechanical properties: Yield strength (MPa) | Mechanical properties: Tensile strength (MPa) | Mechanical properties: Impact absorption energy at −50° C. (J) | Surface crack depth (mm) |
|---|---|---|---|---|---|---|---|---|---|---|
| Inventive Example 1 | Inventive steel 1 | 16.5 | 14.3 | 35 | 0 | 0.021 | 410 | 551 | 257 | No observation |
| Inventive Example 2 | Inventive steel 2 | 17.2 | 15.2 | 24 | 1 | 0.025 | 389 | 535 | 268 | No observation |
| Inventive Example 3 | Inventive steel 3 | 20 | 14.2 | 20 | 1 | 0.031 | 390 | 513 | 238 | No observation |
| Inventive Example 4 | Inventive steel 4 | 15.9 | 13.9 | 31 | 2 | 0.019 | 408 | 539 | 218 | No observation |
| Inventive Example 5 | Inventive steel 5 | 16.5 | 15.1 | 28 | 3 | 0.023 | 399 | 541 | 298 | No observation |
| Comparative Example 1 | Inventive steel 1 | 15.9 | 13.8 | 31 | 0 | 0.024 | 405 | 528 | 208 | 19.5 |
| Comparative Example 2 | Inventive steel 1 | 18.1 | 16.5 | 32 | 2 | 0.03 | 403 | 529 | 12 | No observation |
| Comparative Example 3 | Inventive steel 2 | 18.5 | 14.2 | 29 | 1 | 0.018 | 388 | 534 | 254 | 23.9 |
| Comparative Example 4 | Inventive steel 2 | 17.3 | 16.7 | 18 | 2 | 0.015 | 389 | 529 | 236 | 18.9 |
| Comparative Example 5 | Inventive steel 3 | 21.3 | 15.5 | 38 | 3 | 0.014 | 394 | 534 | 15 | No observation |
| Comparative Example 6 | Inventive steel 3 | 15.6 | 14.9 | 30 | 2 | 0.024 | 390 | 530 | 18 | No observation |
| Comparative Example 7 | Inventive steel 4 | 16.6 | 15.2 | 5 | 23 | 0.033 | 340 | 485 | 8 | No observation |
| Comparative Example 8 | Inventive steel 4 | 18.2 | 16.1 | 27 | 2 | 0.018 | 390 | 559 | 27 | No observation |
| Comparative Example 9 | Comparative steel 1 | 20.5 | 14.1 | 30 | 1 | 0.023 | 273 | 451 | 254 | No observation |
| Comparative Example 10 | Comparative steel 2 | 21.4 | 16.2 | 45 | 3 | 0.02 | 350 | 489 | 253 | No observation |
| Comparative Example 11 | Comparative steel 3 | 18.9 | 15.1 | 40 | 2 | 0.015 | 425 | 720 | 21 | No observation |
| Comparative Example 12 | Comparative steel 4 | 18.2 | 14.3 | 3 | 1 | 0.014 | 359 | 501 | 51 | No observation |
| Comparative Example 13 | Comparative steel 5 | 17.8 | 15.3 | 39 | 0 | 0.019 | 597 | 751 | 12 | No observation |

*In Table 3, a* represents the number of strain-induced organic NbC precipitates of 5 to 50 nm per 1 $\mu m^2$ observed in the cross-section of the steel material, and b* represents the number of coarse precipitates of 100 nm or more.

It can be seen from Tables 1 to 3 that all of Inventive Examples 1 to 5 satisfying the alloy compositions and manufacturing conditions proposed by the present disclosure have excellent strength and low-temperature impact toughness at −50° C. as well as good surface quality in the flange product state.

On the other hand, Comparative Examples 1 to 8 are cases where the alloy compositions proposed by the present disclosure are satisfied but the manufacturing conditions are not satisfied, and it can be seen that the strength and low-temperature impact toughness values are low as the characteristics proposed by the present disclosure, such as the porosity of the central portion and the ferrite grain size in the flange product state, are not satisfied. In addition, even if the material is good, even when the forging ratio conditions are not met at each step of forging, poor surface quality properties may be confirmed in the product state due to the occurrence of surface cracks or penetrating cracks.

Meanwhile, Comparative Examples 9 to 13 satisfy the manufacturing conditions proposed by the present disclosure, but do not satisfy the alloy compositions, so it can be seen that the quality level is low, such as exceeding the strength (less than impact toughness) or less than the strength.

As described above, exemplary embodiments in the present disclosure have been described in the detailed description of the present disclosure, but those of ordinary skill in the art to which the present disclosure pertains may be variously modified without departing from the scope of the present disclosure. Therefore, the scope of the present disclosure is not construed as being limited to the embodiments described above, but should be defined by the following claims as well as equivalents thereto.

The invention claimed is:

1. An ultrathick steel material for a flange, comprising: by wt %, C: 0.05 to 0.2%, Si: 0.05 to 0.5%, Mn: 1.0 to 2.0%, Al: 0.005 to 0.1%, P: 0.01% or less, S: 0.015% or less, Nb: 0.001 to 0.07%, V: 0.001 to 0.3%, Ti: 0.001 to 0.03%, Cr: 0.01 to 0.3%, Mo: 0.01 to 0.12%, Cu: 0.01 to 0.6%, Ni: 0.05 to 1.0%, Ca: 0.0005 to 0.004%, and the balance of Fe and inevitable impurities, has Ceq satisfying a range of 0.35 to 0.55 as calculated by the following equation 1, and the ultrathick steel material has a microstructure comprising of 5 to 30 area % of pearlite and the balance of ferrite, and the ferrite has an average grain size of 25 m or less in a central portion of the steel material, a porosity of the central portion of the steel material, which is an area of ⅜ to ⅝t in a thickness direction from a surface of the steel material, is 0.05 $mm^3/g$ or less, and the number of strain-induced NbC precipitates of 5 to 50 nm observed in a cross-section of the steel material is 10 or more, and the number of coarse precipitates of 100 nm or more is 5 or less, per 1 $\mu m^2$ $$Ceq = [C] + [Mn]/6 + ([Cr] + [Mo] + [V])/5 + ([Ni] + [Cu])/15 \quad \text{[Equation 1]}$$

wherein, in the above equation 1, [C], [Mn], [Cr], [Mo], [V], [Ni], and [Cu] mean a content (wt %) of C, Mn, Cr, Mo, V, Ni, and Cu contained in the steel material, respectively, and when these components are not intentionally added, 0 is substituted.

2. The ultrathick steel material of claim 1, wherein the steel material has a thickness of 200 to 500 mm.

3. The ultrathick steel material of claim 1, wherein the steel material has a tensile strength of 500 to 700 MPa, a yield strength of 350 MPa or more, and a Charpy impact test absorption energy value of 50 J or more at −50° C.

4. The ultrathick steel material of claim 1, wherein a maximum surface crack depth of the steel material is 0.1 mm or less (including 0).

5. A manufacturing method for an ultrathick steel material for a flange, comprising:

preparing a slab comprising, by wt %, C: 0.05 to 0.2%, Si: 0.05 to 0.5%, Mn: 1.0 to 2.0%, Al: 0.005 to 0.03, P: 0.01° o or less, S: 0.015% or less, Nb: 0.001 to 0.07%, V: 0.001 to 0.3% o, Ti: 0.001 to 0.03% o, Cr: 0.01 to 0.3% o, Mo: 0.01 to 0.12% o, Cu: 0.01 to 0.6% o, Ni: 0.05 to 1.0%, Ca: 0.0005 to 0.004%, and the balance of Fe and inevitable impurities, and Ceq satisfying a range of 0.35 to 0.55 as calculated by the following equation 1 and then heating the slab in a temperature within a range of 1100 to 1300° C.;

performing primary upsetting on the heated slab at a forging ratio of 1.3 to 2.4 and then bloom forging on the heated slab at a forging ratio of 1.5 to 2.0;

reheating the bloom-forged material to a temperature within a range of 1100 to 1300° C.;

performing secondary upsetting on the reheated bloom-forged material to a forging ratio of 1.3 to 2.3 and then round forging on the reheated bloom-forged material to a forging ratio of 1.65 to 2.25;

performing tertiary upsetting on the round-forged material at a forging ratio of 2.0 to 2.8 so that a cumulative reduction amount is 10% or more at a temperature of recrystallization temperature or lower defined by the following Equation 2;

performing hole processing on the tertiary upset material, reheating the tertiary upset material to a temperature within a range of 1100 to 1300° C., and then performing ring forging on the reheated tertiary upset material at a forging ratio of 1.0 to 1.6; and performing normalizing heat treatment by heating the ring-forged material to a temperature within a range of 820 to 930° C. that is a temperature measured based on the central portion thereof, maintaining the heated ring-forged material for 5 to 600 minutes, and then air cooling the heated ring-forged material to room temperature $$Ceq = [C] + [Mn]/6 + ([Cr] + [Mo] + [V])/5 + ([Ni] + [Cu])/15 \quad \text{[Equation 1]}$$

wherein in the above equation 1, [C], [Mn], [Cr], [Mo], [V], [Ni], and [Cu] mean a content (wt %) of C, Mn, Cr, Mo, V, Ni, and Cu contained in the steel material, respectively, and when these components are not intentionally added, 0 is substituted $$T_{nr}(^\circ\ C.) = 887 + 464 \times C + 890 \times Ti + 363 \times Al - 357 \times Si + \left(6445 \times Nb - 644 \times Nb^{1/2}\right) + \left(732 \times V - 230 \times V^{1/2}\right). \quad \text{[Equation 2]}$$

6. The manufacturing method of claim 5, wherein the slab is manufactured using one of a continuous casting process, a semi-continuous casting process, and an ingot casting process.

7. The manufacturing method of claim 5, wherein a size of a forged surface punched during the primary upsetting is 1000 to 1200 mm×1800 to 2000 mm when an initial size is 700 mm×1800 mm.

8. The manufacturing method of claim 5, wherein, for the bloom forging, the size of the forged surface upon the completion of forging is 1450 to 1850 mm×2100 to 2500 mm when an initial size is 1000 to 1200 mm×1800 to 2000 mm.

9. The manufacturing method of claim 5, wherein, when the secondary upsetting and round forging end, a size of the product is 1450 to 18500×1300 to 1700 mm.

10. The manufacturing method of claim 5, wherein, when the tertiary upsetting ends, a size of the product is 2300 to 2800Ø×400 to 800 mm.

11. The manufacturing method of claim 5, wherein a maximum thickness of the flange made of the steel material is 200 to 500 mm, an inner diameter is 4000 to 7000 mm, and an outer diameter is 5000 to 8000 mm.

* * * * *